US005963124A

United States Patent [19]

Buss et al.

[11] Patent Number: 5,963,124

[45] Date of Patent: Oct. 5, 1999

[54] COVER MOUNTED POSITION SENSOR

[75] Inventors: Gary L. Buss; John R. Gietzen, both of Elkhart; James E. Haugh, Granger; Murray Kaijala, Elkhart; William G. Osmer, Granger; John Zdanys, Jr., Elkhart, all of Ind.

[73] Assignee: CTS Corporation, Elkhart, Ind.

[21] Appl. No.: 09/201,202

[22] Filed: Nov. 30, 1998

[51] Int. Cl.[6] ..... H01C 10/32

[52] U.S. Cl. ..... 338/162; 338/118; 338/160; 338/161

[58] Field of Search ..... 338/118, 160, 338/161, 162, 164, 167, 170, 174, 188, 190, 199

[56] References Cited

U.S. PATENT DOCUMENTS 4,334,352 6/1982 VanBenthuysen .
4,430,634 2/1984 Hufford et al. .
4,435,691 3/1984 Ginn .
4,616,504 10/1986 Overcash et al. .
4,688,420 8/1987 Minagawa .
4,703,649 11/1987 Eitoku et al. .
5,039,975 8/1991 Ishihara .
5,133,321 7/1992 Hering et al. .
5,321,980 6/1994 Hering et al. .
5,385,068 1/1995 Whit et al. .
5,415,144 5/1995 Hardin et al. .
5,416,295 5/1995 White et al. .
5,672,818 9/1997 Schaefer et al. .
5,828,290 10/1998 Buss et al. .

*Primary Examiner*—Michael L. Gellner
*Assistant Examiner*—Richard Lee
*Attorney, Agent, or Firm*—Michael W. Starkweather; Mark Bourgeois

[57] ABSTRACT

A position sensor for sensing the position of an attached device. There is a housing having terminals and a cover attached to the housing. Resistors, conductors and conductive traces are located on the cover and electrically connected to the terminals. A rotor is positioned between the housing and the cover, and has a contactor mounted thereon for contacting the resistor and the conductor such that as the rotor rotates a resistance value indicative of the sensor position is varied. The cover has a terminal insert which connect between the conductive traces and the terminals. A leaf spring rotates the rotor back to a starting position.

6 Claims, 2 Drawing Sheets

COVER MOUNTED POSITION SENSOR

BACKGROUND OF THE INVENTION

1. Field of the Invention

This invention relates to independent and self-contained position sensors for sensing the position of an attached device. In particular, there is a cover mounted position sensor that has resistors and conductors mounted on the cover of the sensor housing.

2. Description of the Related Art

Various devices and methods of dealing with the design of position sensors are legion. Examples of patents related to the present invention are as follows, and each patent is herein incorporated by reference for the supporting teachings:

U.S. Pat. No. 5,672,818, is a throttle valve adjusting unit.

U.S. Pat. No. 5,416,295, is a combined pedal force switch and position sensor.

U.S. Pat. No. 5,415,144, is a throttle position validation method and apparatus.

U.S. Pat. No. 5,385,068, is an electronic accelerator pedal assembly with pedal force sensor.

U.S. Pat. No. 5,321,980, is an integrated throttle position sensor with independent position validation sensor.

U.S. Pat. No. 5,133,321, is an integrated throttle control and idle validation sensor.

U.S. Pat. No. 5,039,975, is a resistor substrate for a variable resistor employed in a throttle sensor.

U.S. Pat. No. 4,703,649, is a throttle valve opening sensor.

U.S. Pat. No. 4,688,420, is a throttle valve position detecting device for a vehicle engine.

U.S. Pat. No. 4,616,504, is a throttle position sensor with a potentiometer module that fits into a connector casing.

U.S. Pat. No. 4,435,691, is a dual track resistor element having nonlinear output.

U.S. Pat. No. 4,334,352, is a method of making a variable resistance control.

U.S. Pat. No. 4,430,634, is a rotary potentiometer with molded terminal package.

U.S. Pat. No. 5,828,290, is a modular position sensor.

The foregoing patents reflect some of the relevant of which the applicant is aware and are tendered with the view toward discharging applicants' acknowledged duty of candor in disclosing information that may be pertinent in the examination of this application. It is respectfully stipulated, however, that none of these patents teach or render obvious, singly or when considered in combination, the applicant's claimed invention.

3. Problem with the Related Art

There are several common problems occurring with the prior art. It can be more expensive, for example, to make a sensor unit that contains more parts. In particular, using a separate assembly or piece to hold the sensing elements such as a flexible film is expensive. The separate assembly requires additional holding mechanisms and assembly steps during fabrication. It would be less expensive to be able to omit some components and have fewer parts to assemble. Therefore, there is a need for a position sensor unit that is less expensive.

The preferred embodiment of the invention is designed to solve the problems herein described and other problems not discussed, which are discoverable by a skilled artisan.

SUMMARY OF THE INVENTION

It is a feature of the invention to provide an independent and self-contained position sensor for sensing the position of an attached device. In particular, there is a cover mounted position sensor that has resistors and conductors mounted on the cover of the sensor housing.

Yet, another feature of the invention is to provide a position sensor that includes a housing having a plurality of terminals attached. A cover is attached to the housing. The cover has several resistors and conductors mounted thereon. Several conductive traces are located on the cover and electrically connect the conductors and resistors to the terminals. A rotor is positioned between the housing and the cover, and has a contactor mounted thereon for contacting the resistor and the conductor such that as the rotor rotates a resistance value indicative of the sensor position is varied. The cover has a terminal insert which connects between the conductive traces and the terminals. A leaf spring rotates the rotor back to a starting position.

It is a feature of the invention to provide a position sensor that includes a housing having a several terminals attached to the housing and a cover attached to the housing. A sensor mechanism is located on the cover and is electrically connected to the terminals for sensing the position of an attached device and generating an electrical signal representative thereof. A rotor mechanism is positioned between the housing and the cover for contacting the sensor mechanism such that as the rotor mechanism rotates the electrical signal is varied. A leaf spring rotates the rotor back to a starting position.

The invention resides not in any one of these features per se, but rather in the particular combination of all of them herein disclosed and claimed. Those skilled in the art will appreciate that the conception, upon which this disclosure is based, may readily be utilized as a basis for the designing of other structures, methods and systems for carrying out the several purposes of the present invention. Further, the abstract is neither intended to define the invention of the application, which is measured by the claims, neither is it intended to be limiting as to the scope of the invention in any way.

Figure 1:
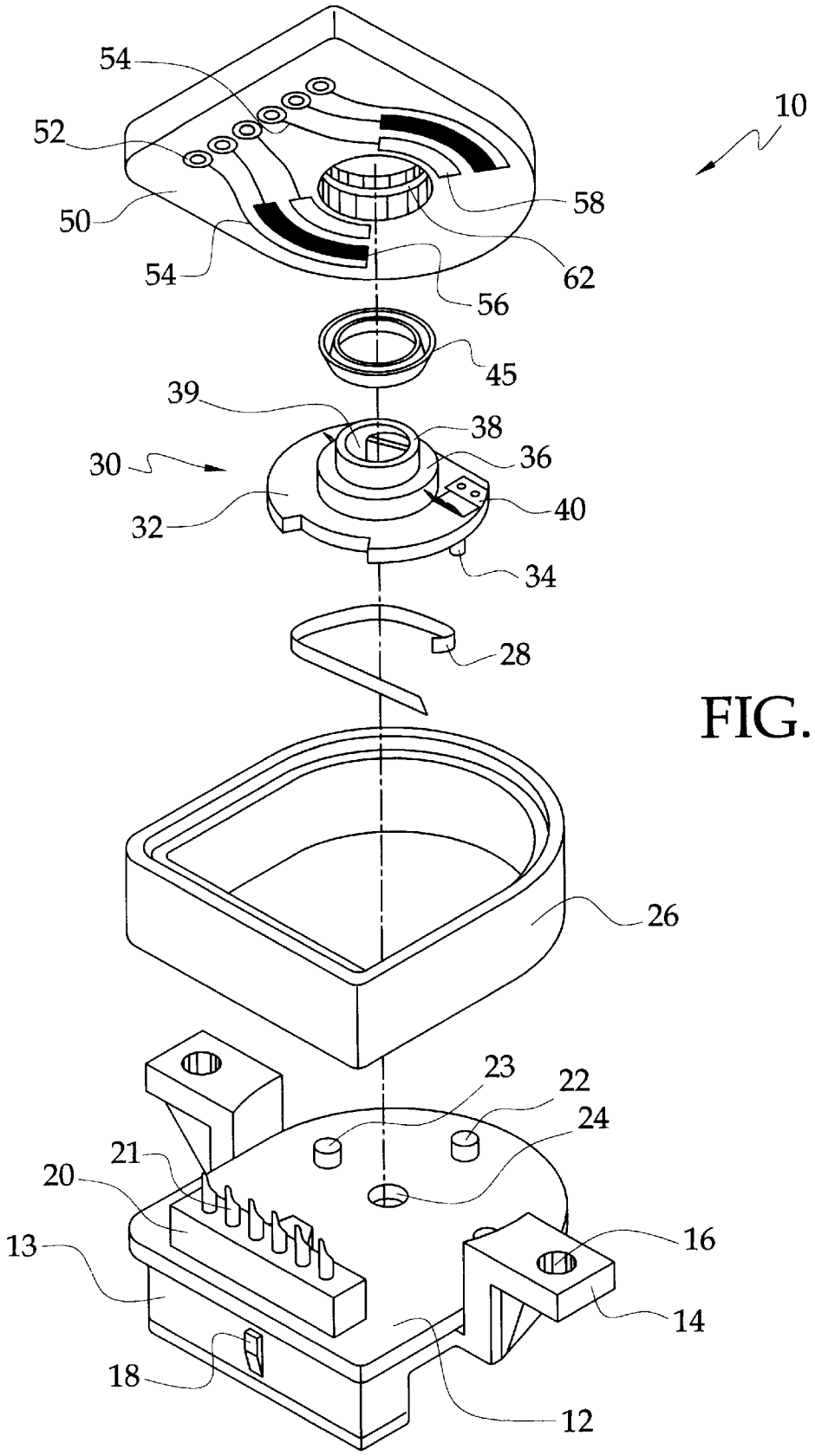
FIG. 1 is an exploded perspective view of a Cover Mounted Position Sensor.

It is noted that the drawings of the invention are not to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements between the drawings.

DETAILED DESCRIPTION OF THE PREFERRED EMBODIMENT

Figure 2:
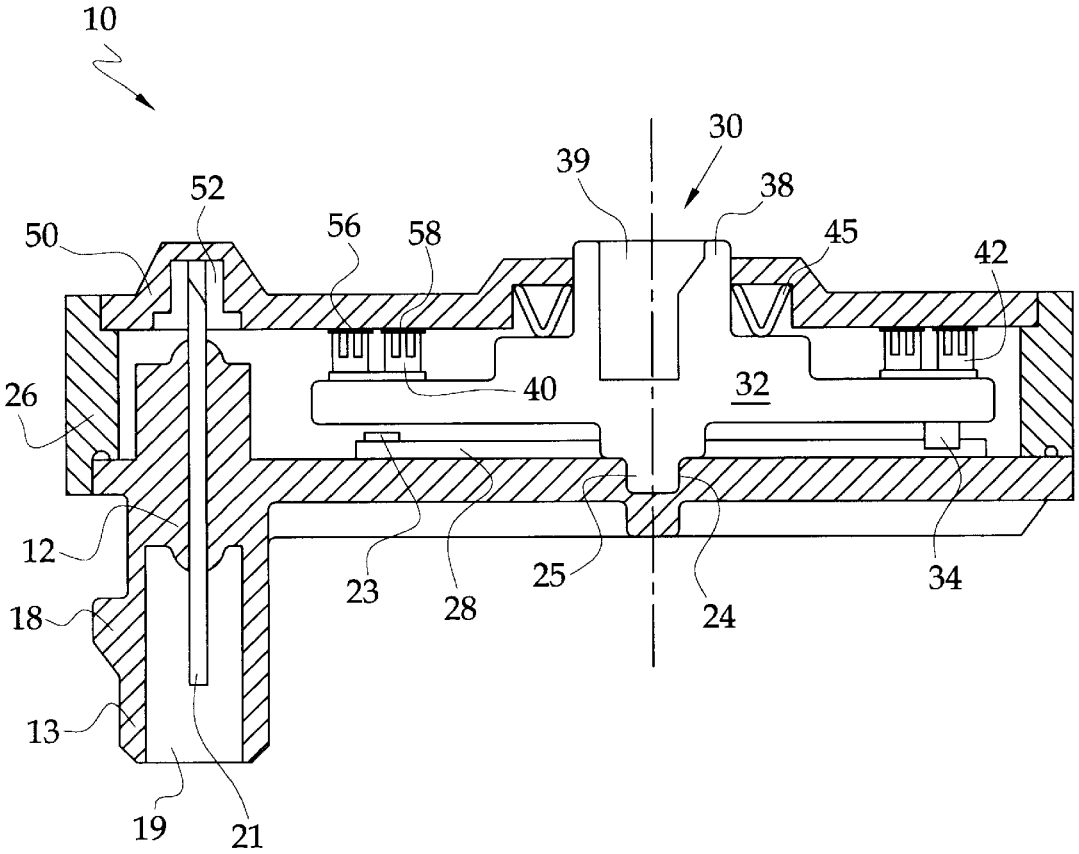
FIG. 2 is a cross sectional assembled view of FIG. 1.

Referring to FIGS. 1 and 2, a cover mounted position sensor 10 is shown. A housing 12 has a connector shroud 13 and a pair of mounting flanges 14 attached. Mounting flange 14 has a mounting hole 16 passing therethrough for bolting or screwing to a mounting location. A connector tab 18 and connector aperture 19 are located on connector shroud 13 for connecting with an external electrical connector (not shown). A terminal flange 20 extends upwardly from the top surface of housing 12 and holds terminals 21. A first spring post 22 and a second spring post 23 extend upwardly form the top surface of the housing and a recess 24 extends into the housing. A spacer 26 is ultrasonically welded to housing 12. A rotor assembly 30 has a rotor body 32, a rotor support portion 25 that fits into recess 24, a spring actuator 34 that extends below rotor body 32 and a rotor flange 36 extends upwardly from rotor body 32. Rotor 30 further has a rotor body upper portion 38 and a shaft aperture 39 in an end of the rotor body. A shaft (not shown) on an adjacent device would rest in and be held by shaft aperture 39 during operation. A pair of contactors 40 is mounted to rotor body 32. Contactors 40 have several contact fingers 42 extending outwardly. A leaf spring 28 has one end that is held by spring post 22. Leaf spring 28 wraps around spring post 23 and has another end held by spring actuator 34. Leaf spring 28 rotates rotor assembly 30 back to a starting position.

A cover 50 is ultrasonically welded over spacer 26 to enclose rotor assembly 30. Cover 50 has terminal inserts 52 therein, conductive traces 54, resistors 56, conductors 58 and a cover hole 62. Terminal inserts 52 are copper inserts that are insert molded into cover 50 and electrically connect terminals 21 to conductive traces 54. Conductive traces 54, resistors 56, and conductors 58 are conventional thick film materials applied by conventional thick film techniques. A seal 45 is located between cover 50 and rotor flange 36 to seal the sensor from potentially harmful external environmental conditions.

Position sensor 10 is assembled as follows: First, terminals 21 are insert molded into housing 12. Spacer 26 is then ultrasonically welded to housing 12. Contactors 40 are heat staked to rotor body 32. Spring 28 has an end attached to post 22 and is then wrapped around post 23. Rotor 30 is placed on housing 12 with the other end of spring 28 resting against spring actuator 34. Next, seal 45 is placed over rotor upper body 38. Terminal inserts 52 are insert molded into cover 50 then the traces 54, resistors 56 and conductors 58 are screen printed and cured on cover 50. The cover 50 is then placed on and ultrasonically welded to spacer 26 completing the assembly. During installation of cover 50, terminals 21 press-fit into terminal inserts 52.

Position sensor 10 operates as follows: a rotating shaft of an external device whose position is desired to be sensed is located in shaft aperture 39 and as the shaft rotates, rotor assembly 30 also rotates. As rotor body 32 rotates, contact fingers 42 are swept across resistors 56 and conductors 58 causing a measured electrical resistance to change or an applied voltage level to change. An external electrical signal applied to the terminals is conducted through a terminal 21, terminal insert 52, trace 54, resistor 56, contact fingers 42, through another set of contact fingers 40, conductor 58, another trace 54, another terminal insert 52 and to another terminal 21 where it connects with an external electrical connector such as a wiring harness. As the rotor 30 rotates, the resistance value indicative of the shaft position varies. Leaf spring 28 is coupled to the rotor 30 and rotates the rotor back to a starting position when force on the shaft is released.

Remarks About the Preferred Embodiment

One of ordinary skill in the art of designing and using position sensors will realize many advantages from studying and using the preferred embodiment. For example, since the resistors and conductors are located on the cover, the sensor unit can be produced less expensively than previous sensor devices that included a separate piece such as a flexible film.

One skilled in the art would also realize that cover 50, rotor 30 and spacer 26 could be a standard set of parts and that only housing 12 need be changed to customize the independent and self contained sensor for a particular application of sensor mounting orientation or connector requirements.

A skilled artisan will understand that the terminal inserts 52 provide a disconnectable electrical connection between the traces and the terminals.

One knowledgeable in the art would also realize that the leaf spring 28 has advantages over a coil spring for short degrees of rotation. For example, the leaf spring is easier to install and less expensive.

One skilled in the art would know that the connector shroud 13 is used for both mechanically and electrically coupling to external electrical wires (not shown), for example. The electrical wires are used for directing power to the sensor, and for directing position sensor signals to appropriate devices. Of course, the shroud encloses either female or male electrical contacts for coupling to the external wires.

A skilled artisan will understand that although the position sensor was shown in a particular application, an infinite number of applications are possible for such a device and it is manifestly intended that the applications be limited only by the possibilities of the human imagination.

Variations of the Preferred Embodiment

Although the illustrated embodiments discuss using ultrasonic welding to connect spacer 26 to housing 12 and cover 50, it is contemplated to use heat staking or adhesives or press-fitting.

An additional variation of the invention contemplates the use of a different connection between terminals 21, inserts 52 and conductive traces 54. For example, solder could be used to electrically connect terminal 21 to trace 54, omitting insert 52. Also, other types of connectors could be pressed between traces 54 and terminals 21 such as a z-axis tape interconnect product which has columns of electrical connections in the z-axis.

Although the preferred embodiment depicts a certain shaped cover 50, many variations are possible. For example, the resistors 56 and conductors 58 could be at one end of cover 50. Additionally, it is even contemplated to place the resistors and conductors in different locations, like on one side of the cover or even on the inside surface of the housing. Of course this would require a different shaped rotor 30. It is also, contemplated to include more or fewer resistors 56 or conductors 58 on cover 50.

Although spacer 26 was shown as a separate piece, It is contemplated to integrally mold spacer 26 as part of housing 12 or cover 50.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the description. All changes that come within the meaning and range of equivalency of the claims are to be embraced within their scope.

What we claim and desire to be secured by United States Patent is:

1. A position sensor for sensing the position of an attached object, comprising:

a) an independent and self contained housing;

b) a plurality of terminals attached to the housing, the terminals extending from the housing;

c) a cover attached to the housing including:

c1) at least one resistor disposed on the cover;

c2) at least one conductor disposed on the cover;

c3) a plurality of conductive traces disposed on the cover and electrically connecting the conductors and resistors to the terminal;

c4) a plurality of conductive inserts, located in the cover, and electrically connected to the conductive traces, the terminals extending into and mating with the conductive inserts;

d) a rotor, positioned between the housing and the cover, and having a contactor disposed thereon for contacting the resistor and the conductor such that as the rotor rotates a resistance value varies indicating the position of the attached object.

2. The position sensor according to claim 1, wherein the rotor has a leaf spring, coupled around the rotor, for rotating the rotor back to a starting position.

3. The position sensor according to claim 1, wherein a spacer is located between the cover and the housing.

4. The position sensor according to claim 1, wherein a seal is located between the cover and the rotor.

5. The position sensor of claim 1, wherein the housing has a shroud for coupling to an external electrical connector.

6. A position sensor for sensing the position of an attached device, comprising:

a) an independent and self contained housing having a plurality of terminals attached therein;

b) a cover, attached to the housing, and having a plurality of conductive inserts, located therein, the terminals extending from the housing into and mating with the conductive inserts, the terminals and the conductive inserts forming separable electrical connections;

c) a sensor, disposed on the cover and electrically connected to the terminals, for sensing the position of the attached device and generating an electrical signal representative thereof including:

c1) at least one resistor;

c2) at least one conductor; and c3) a plurality of conductive traces electrically connected between the conductors and the conductive inserts and between the resistors and the conductive inserts; and d) a rotor having a contactor for contacting the sensor and a leaf spring for rotating the rotor back to a starting position.

* * * * *